US005832784A

United States Patent [19]

McCallips et al.

[11] Patent Number: 5,832,784

[45] Date of Patent: Nov. 10, 1998

[54] VARIABLE RATIO PARKING BRAKE CONTROL WITH ENHANCED CABLE TAKE-UP

[75] Inventors: Lavern R. McCallips, Roscoe, Ill.; Brian J. Czopek, St. Clair Shores, Mich.

[73] Assignee: Dura Automotive Systems, Inc., Rochester Hills, Mich.

[21] Appl. No.: 819,347

[22] Filed: Mar. 18, 1997

[51] Int. Cl.[6] ..... G05G 1/14

[52] U.S. Cl. ..... 74/512; 74/516

[58] Field of Search ..... 74/512, 516, 517, 74/518

[56] References Cited

U.S. PATENT DOCUMENTS

| | | | |
|---|---|---|---|
| 3,646,830 | 3/1972 | Schrock | 74/516 |
| 3,897,694 | 8/1975 | Hirst Jr. . | |
| 3,938,407 | 2/1976 | Nisbet | 74/516 |
| 4,075,907 | 2/1978 | Petrzelka . | |
| 4,854,187 | 8/1989 | Walters . | |
| 5,211,072 | 5/1993 | Barlas et al. . | |
| 5,217,094 | 6/1993 | Walter et al. . | |
| 5,272,935 | 12/1993 | Heinemann et al. . | |
| 5,280,734 | 1/1994 | Riffle et al. . | |
| 5,448,928 | 9/1995 | Harger . | |
| 5,528,956 | 6/1996 | Harger et al. . | |
| 5,528,957 | 6/1996 | Belmond et al. . | |

*Primary Examiner*—Charles A. Marmor
*Assistant Examiner*—Mary Ann Battista
*Attorney, Agent, or Firm*—Michael K. Boyer

[57] ABSTRACT

A parking brake control for operating a parking brake cable between a release position and a brake engagement position comprises a mounting plate assembly, an input lever assembly which translates and rotates with respect to the mounting plate assembly, and a sector which is slidably attached to the mounting plate assembly and rotatable in response to movement of the input lever assembly, wherein rotation of the sector towards the brake engagement position produces a tension force on a cable. The parking brake control can further comprise a first rivet extending into a slot in the input lever assembly; preferably the sector rotates around the first rivet. In addition, a second rivet may be attached to the input lever assembly and received by both a cam slot in the mounting plate assembly and a slot in the sector. The parking brake control produces an output tension force on the cable, pulling the cable away from the parking brake to actuate the parking brake.

20 Claims, 2 Drawing Sheets

VARIABLE RATIO PARKING BRAKE CONTROL WITH ENHANCED CABLE TAKE-UP

FIELD OF THE INVENTION

The present invention generally relates to an improved parking brake control for locking and releasing a parking brake for a motor vehicle, and more particularly to parking brake controls transmitting and releasing a tension force on a cable to actuate a parking brake.

BACKGROUND OF THE INVENTION

Parking brakes are used as an auxiliary brake system to hold a motor vehicle in position, especially when the motor vehicle is parked on a steep incline. Typically a parking brake control is located remote from the brake, usually near a driver's position in the motor vehicle. A cable is routed through the vehicle connecting the parking brake control with the parking brake. In known designs the parking brake control has a rotatable lever assembly comprising either a foot pedal or a hand lever. Rotation of the lever assembly applies a tension force to the cable which actuates the parking brake, and release of the tension force on the cable releases the parking brake.

Parking brake controls have competing design criteria. On one hand, the tension force on the cable must be sufficient to engage and lock the parking brake to restrain the motor vehicle, even if the motor vehicle is on a steep incline. On the other hand, an input force needed to force the lever assembly into the full brake engagement position must be maintained at a reasonable level. In addition, space constraints limit the range of motion of the parking brake control. The parking brake control must produce cable motion between a full release position and a full brake engagement position sufficient to lock and hold the parking brake. Typically in automotive applications today, the lever assembly is designed so that its range of motion is at most no more than about 50 degrees. In addition to these competing demands, it is desirable to have the required input force increase as the brake control is moved from the full release position to the full brake engagement position, providing feedback to an operator as to the amount of force that is applied.

Parking brake controls are known as variable ratio if the ratio of input force to output tension force on the cable changes as the parking brake control moves from the full release position to the full brake engagement position. U.S. Pat. No. 5,448,928 to Harger shows one example of a variable ratio parking brake control. A pivoting lever is connected by a pin and slot to a link. The link is connected to a cable. As the lever pivots or rotates a given angle, the link rotates a controllably variable angle, moving the cable a controllably variable distance. However, it would be desirable to increase the total cable travel length without increasing the angle of travel of the lever assembly. It would also be desirable to increase the amount of cable travel that occurs relatively early in the rotation of the lever assembly.

In view of the foregoing, it is an object of the present invention to provide a parking brake control for a parking brake, operating a parking brake cable between a full release position and a full brake engagement position and having enhanced cable take-up. It is an additional object of the present invention, at least in preferred embodiments, to provide a parking brake control of reduced cost and complexity while enhancing manufacturability. It is an additional object of the present invention, at least in preferred embodiments, to provide a parking brake control having low friction between sliding components. It is yet another related object of the present invention to provide such a parking brake control that is highly reliable in operation.

SUMMARY OF THE INVENTION

In accordance with these and other objects, there is provided a variable ratio parking brake control for operating a parking brake cable between a full release position in which a parking brake is not engaged, and a full brake engagement position in which the parking brake is engaged. The parking brake control preferably has a mounting plate assembly fixed to a wall of a motor vehicle, an input lever assembly which is moveable by translation and rotation with respect to the mounting plate assembly, and a rotatable sector which is rotatably attached to the mounting plate assembly. A cable can be attached to the sector such that the cable moves with rotation of the sector. Movement of the input lever assembly toward the full brake engagement position rotates the sector, applying a tensioning force to the parking brake cable to actuate the parking brake.

Preferably the relative motion of the component parts of the parking brake control is accomplished by a series of slots and rivets. The input lever assembly has a slot or the like which receives a first rivet. The input lever assembly translates by the length of the slot as it rotates from the full release position to the full brake engagement position. The sector is rotatable around the first rivet. Preferably a second rivet is attached to the input lever assembly which is received by a sector slot and by a mounting plate assembly cam slot. As the input lever assembly moves, the second rivet moves in the slots, and forces rotation of the sector. The cam slot controls the rate of rotation of the sector, and therefore the rate of cable take-up. Advantageously, the amount of rotation of the sector can be greater than the amount of rotation of the input lever assembly, thereby increasing cable travel length for a given rotation of the input lever assembly. Advantageously, the shape and length of the slots can be altered to easily satisfy widely varying design requirements, such as the desired amount of cable travel and the ratio of input force to output force.

The assembled parking brake control is preferably attached to a cable which is under tension. Without additional control, the force of the cable urges the parking brake control to the full release position. The input lever assembly, which can optionally comprise either a foot pedal or a hand lever, receives an input force which overcomes the force of the cable on the parking brake control and thereby actuates the parking brake. To secure the parking brake, that is, to prevent the parking brake control from returning to the full release position after the input force is released, means for releasably locking the sector are provided, which can comprise, for example, a ratchet and pawl or a one-way clutch. For embodiments using a one-way clutch, the sector can have teeth that mesh with teeth of a pinion. The pinion is preferably rotatably attached to the mounting plate assembly and has a wrap spring wrapped around the pinion. The wrap spring allows the pinion to rotate only so that the sector rotates in the direction toward the full brake engagement position. Thus, the lever assembly can only be pushed toward the full brake engagement position. A release lever can be used to force the spring to unwind, thereby allowing free rotation of the pivot. The force of the cable on the sector (unrestrained by the wrap spring on the pinion) urges the sector to return to the full release position.

From the foregoing disclosure and the following more detailed description of various preferred embodiments it will be apparent to those skilled in the art that the present invention provides a significant advance in the technology and art of parking brake controls. Particularly significant in this regard is the potential the invention affords for increased cable travel length for a given rotation of the lever assembly, for design selection of the ratio of input force to output force on the cable, and for reduced or minimized frictional forces while reducing cost, operating noise, and complexity. Additional features and advantages of various preferred embodiments will be better understood in view of the detailed description provided below.

Figure 1:
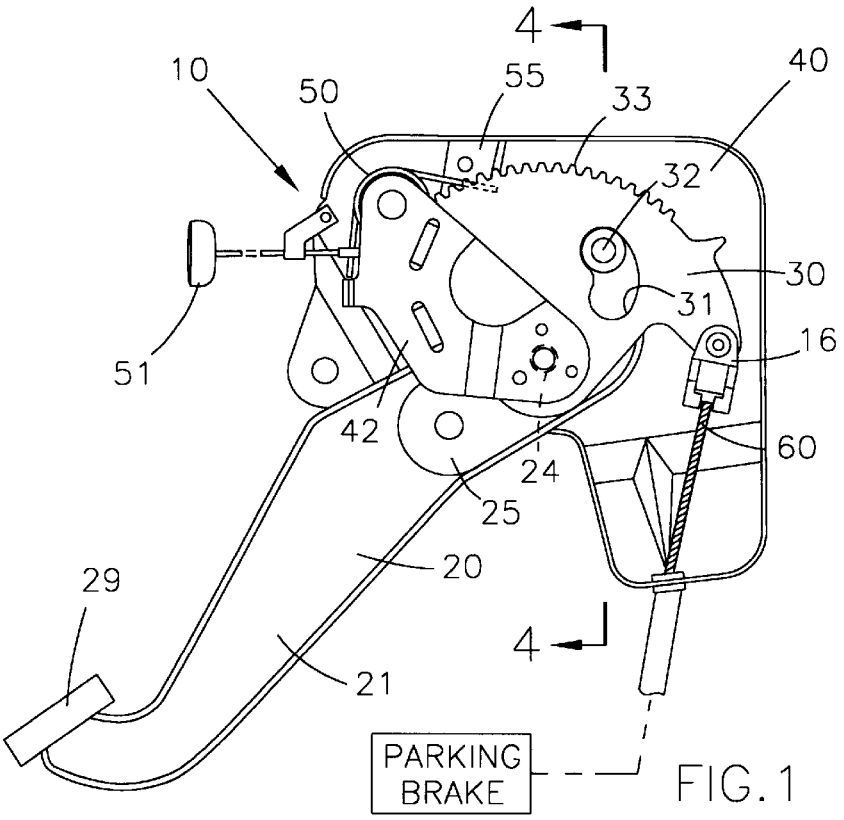
FIG. 1 is a side elevation view of a preferred embodiment of a new and improved variable ratio parking brake control.

It should be understood that the appended drawings are not necessarily to scale, presenting a somewhat simplified representation of various preferred features illustrative of the basic principles of the invention. The specific design features of a variable ratio parking brake control as disclosed here, including, for example, the cross sectional thickness of the sector, and the specific dimensions of the pedal and cam slots, mounting plate slot and sector slot will be determined in part by the particular intended application and use environment. Certain features of the illustrated embodiments have been enlarged or distorted relative to others to facilitate visualization and clear understanding. In particular, thin features may be thickened, for clarity of illustration. All references to direction and position, unless otherwise indicated, refer to the orientation of the parking brake control illustrated in the drawings. In general, lateral or laterally refers to a rightward or leftward direction in the plane of the paper in the side view of FIG. 1, and up, down or vertical refers to corresponding up, down and vertical directions in the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the parking brake controls disclosed herein. The following detailed discussion of various alternative and preferred features and embodiments will illustrate the general principles of the invention with reference to a parking brake control intended to be actuated by the foot of an operator, although the principles of the invention will be applicable to parking brake controls intended to be actuated by hand.

Figure 2:
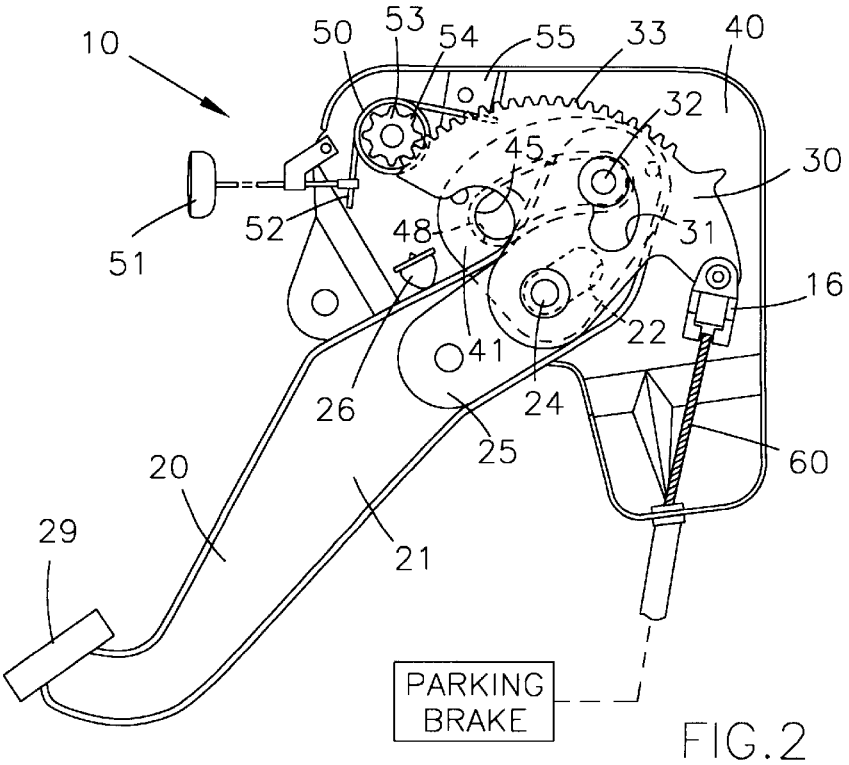
FIG. 2 is a side elevation view of the variable ratio parking brake control of FIG. 1 with the cover plate removed, shown in a full release position.
Figure 3:
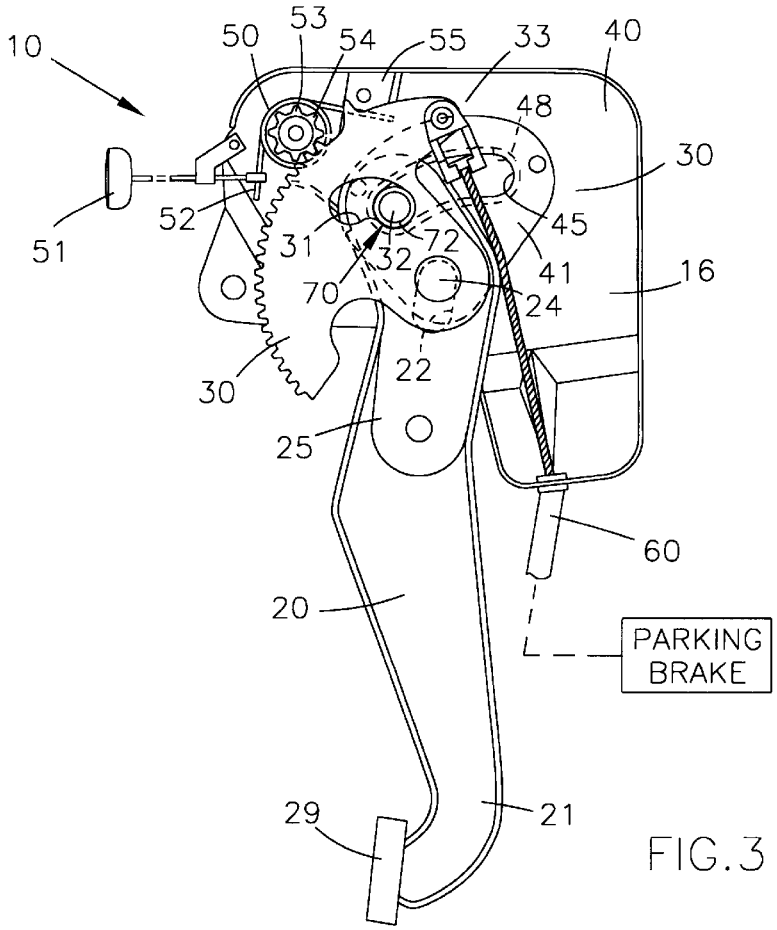
FIG. 3 is a side elevation view the variable ratio parking brake control of FIG. 1 shown in a full brake engaged position.

Referring now to the drawings, FIG. 1–3 show side elevation views of a preferred embodiment of a variable ratio parking brake control 10 for a motor vehicle showing a lever assembly for receiving an input force, and a cable 60 for transmitting an output tension force to a remotely located parking brake. The output force, as described below, is variable in the sense that a given input force produces a different output force along the range of motion of the lever assembly. The parking brake control has a mounting plate assembly comprising cam plate 41 having cam slot 45. The degree of curvature of the cam slot 45 affects the rate of rotation of a sector 30. The sector 30 has a banana slot 31 and is rotatable as the parking brake control 10 moves from the full release position to the full brake engagement position. Preferably sector 30 has cable attachment means, such as pivotable clevis 16 receiving cable 60, so that the cable moves directly in response to rotation of the sector.

The mounting plate assembly can optionally further comprise a mounting plate 40 and cover 42. Cam plate 41 having cam slot 45 is fixedly attached to the mounting plate. For ease of assembly, the mounting plate can have a mounting plate slot 48 which generally tracks the shape of the cam slot 45. A separate cam plate has additional advantages, such as enhancing the strength of the parking brake control so as to resist torsional stresses. Moreover, this design can be a "universal" parking brake control, used on multiple motor vehicle lines, in that substitution of the cam plate with a cam slot of different length and/or curvature allows for parking brake controls which can have different cable take-up lengths and different sector rotation angles. Sector 30 is preferably attached to rivet 24 so that it rotates with respect to the mounting plate in response to motion of the input lever assembly.

The lever assembly preferably comprises a pedal 20 having a foot pad 27. A slot 22 in pedal 20 allows the pedal to have translational motion as it rotates, as described in greater detail below. The amount of translational motion varies with the length of the slot. Advantageously, reinforcement plate 25 may be affixed to the pedal 20 to increase the thickness of the mounting plate assembly near the slot so as to resist torsional bending of the lever assembly.

FIGS. 2 and 3 show the variable ratio parking brake control of FIG. 1 with the cover 42 removed for clarity of illustration. In FIG. 2, the parking brake control 10 is in a full release position, wherein the parking brake control does not actuate the parking brake. In FIG. 3 the parking brake control 10 is shown in a full brake engagement position, wherein the parking brake control actuates the parking brake. The amount of output tension force applied to the cable 60 necessary to engage the parking brake varies, in part with the angle of the surface that the motor vehicle rests upon. It will be apparent to those skilled in the art given the benefit of this disclosure that the parking brake may be lockingly engaged by movement of the parking brake control to a position intermediate between the full release position and the brake engagement position.

First rivet 24 is slidably received in pedal slot 22. A second rivet 32 is attached to the pedal and slidably received in both the sector slot 31 and the cam slot 45. The sector 30 preferably only rotates about the first rivet 24. In accordance with a highly advantageous feature the lever assembly rotates and translates as it moves from the full release position to the full brake engagement position. Pedal arm 21 gets "longer" as the pedal rotates toward the full brake engagement position. That is, the distance between the end of the pedal arm 21 and the first rivet 24 increases by the length of the slot 22. Such translation of the lever assembly acts to increase the effective moment arm of the lever assembly, somewhat ameliorating the high input force required when the output force is high near the full brake engagement position.

As the pedal moves, the second rivet 32 slides in both the sector slot and the cam slot 45. The second rivet forces the sector to rotate. The cam slot controls the rate of rotation. The interconnection between the pedal and the sector advantageously allows the sector to rotate more than the pedal rotates, thereby increasing cable travel. In the example shown in the drawings, as the pedal 20 rotates by about 50 degrees between the full release position and the full brake engagement position, the sector rotates about 83 degrees, and the cable is moved about 79 mm.

The output force rises to approximately 1400 lbs. at the full brake engagement position. Advantageously, the cam slot 45 is shaped so that approximately 30–45%, most preferably about 40 percent of the cable travel occurs in the first 10 degrees of pedal rotation. It will be readily apparent to those skilled in the art, given the benefit of this disclosure, that the length, curvature, and shape of the slots may be modified to change the amount of sector rotation, cable travel, pedal translation motion, or output force applied to the cable.

The assembled parking brake control is connected to the parking brake via the cable 60 which is attached to the sector 30. The cable is normally under tension such that the parking brake control is urged toward the full release position of FIG. 2, such that the pedal 20 contacts bumper stop 26. The lever assembly, which can comprise either a foot pedal or a hand lever, can receive an input force to overcome the force of the cable on the parking brake control. To secure the parking brake control in any position and therefore lock the parking brake, a ratchet and pawl or a one- way clutch 50 is used. For parking brake controls using a one-way clutch, the sector 30 has teeth 33 which engage teeth 54 of a pinion 53. The one-way clutch 50 allows the parking brake to rotate only toward the full brake engagement position. A wrap spring 52 is secured to the mounting plate 40 at anchor 55 and wraps around and bites into a cylindrical portion of the pinion. When the pinion 53 rotates in the direction of wind on the wrap spring 52, the spring deflects allowing relatively free motion of the pinion. When pinion 53 rotates against the direction of wrap, the wrap spring bites into the pinion, preventing rotation of the pinion and locking the parking brake control at that position. A release lever 51 disengages the one-way clutch 50 by partially unwinding wrap spring 52, thereby allowing the pinion 53 to rotate freely, which it does until the sector 30 returns to the fill release position. Other suitable means for releasably locking the sector will be apparent to those skilled in the art given the benefit of this disclosure.

Figure 4:
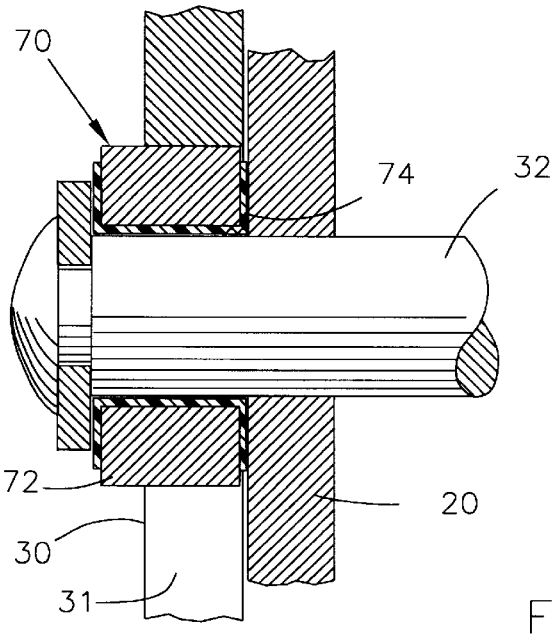
FIG. 4 is an enlarged and exploded, partial cross sectional view of the cam rivet, taken along line 4—4 in FIG. 1, showing a friction reducing cam follower in accordance with a preferred embodiment.

FIG. 4 shows a highly advantageous feature in accordance with a preferred embodiment which reduces friction between the rivets and the slots. Cam follower 70 is positioned around the rivet 32, that is, between the second rivet 32 and the cam plate 41, and can comprise a cam roller 72 which rotates over cam bushing 74. Friction is reduced in that instead of a rivet sliding directly on a slot, the cam follower rotates as the rivet travels in the slot. The cam follower can comprise a pair of friction-reducing cam followers, each rotatable around the second rivet, with the first cam follower contacting an interior surface of the banana slot, and a second cam follower contacting an interior surface of the cam slot. The cam bushing cam be a low friction material, preferably a teflon impregnated material. Alternatively a ball bearing race can be used. Other suitable friction reducing cam follower designs will be apparent to those skilled in the art given the benefit of this disclosure.

From the foregoing disclosure and detailed description of certain preferred embodiments, it will be apparent that various modifications, additions and other alternative embodiments are possible without departing from the true scope and spirit of the invention. For example, parking brake controls as disclosed above (either hand-actuated or foot actuated) may have a sensor which transmits a signal to an indicator on an instrument panel of the motor vehicle to indicate to the operator that the parking brake is engaged. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A variable ratio parking brake control for operating a parking brake cable between a full release position and a full brake engagement position, comprising, in combination:

a mounting plate assembly;

an input lever assembly having a lever arm moveable by translation and rotation with respect to the mounting plate assembly;

a first rivet wherein the input lever assembly has a slot which receives the first rivet and a sector rotatably attached to the mounting plate assembly, for applying a tensioning force to the cable as the input lever assembly moves towards the full brake engagement position.

2. A parking brake control for applying and releasing a parking brake for a motor vehicle between a full release position and a full brake engagement position, comprising, in combination:

a moveable cable for transmitting a tension force to actuate the parking brake;

a fixed mounting plate assembly;

an input lever assembly which rotates and translates with respect to the mounting plate assembly; a first rivet, wherein the lever assembly has a slot which receives the first rivet; and a sector slidably attached to the mounting plate assembly and rotatable in response to movement of the lever assembly, wherein rotation of the sector moves the cable.

3. A parking brake control comprising:

a moveable cable for transmitting force to a parking brake for movement between a full release position and a full brake engagement position;

a mounting plate assembly;

an input lever assembly which rotates and translates with respect to the mounting plate assembly;

a first rivet, wherein the lever assembly has a slot which receives the first rivet;

a sector slidably attached to the mounting plate assembly and rotatable in response to movement of the lever assembly, wherein rotation of the sector moves the cable;

and a second rivet, wherein the sector has a slot which receives the second rivet.

4. The parking brake control of claim 1 or 2 further comprising cable attachment means on the sector for attaching the cable to the sector.

5. The parking brake control of claim 1, 2 or 3 wherein the input lever assembly contacts a bumper at the full release position.

6. The parking brake control of claim 1, 2 or 3 wherein the input lever assembly further comprises a release lever.

7. The parking brake control of claim 1, 2 or 3 wherein the input lever assembly rotates about 50 degrees while the sector rotates about 80 degrees between the full release position and the full brake engagement position.

8. The parking brake control of claim 1 wherein the sector rotates about the first rivet.

9. The parking brake control of claim 1, 2 or 3 further comprising a friction-reducing cam follower rotatable around the first rivet and contacting an interior surface of the slot of the lever assembly.

10. The parking brake control of claim 9 wherein the cam follower comprises a roller rotating over a roller bushing positioned around the first rivet.

11. The parking brake control of claim 1 or 2 further comprising a second rivet, wherein the sector has a slot and the mounting plate assembly has a cam slot, and each slot receives the second rivet.

12. The parking brake control of claim 11 wherein the second rivet is fixedly attached to the input lever assembly.

13. The parking brake control of claim 11 further comprising a pair of friction-reducing cam followers, each rotatable around the second rivet, with a first cam follower contacting an interior surface of the slot in the sector, and a second cam follower contacting an interior surface of the cam slot.

14. The parking brake control of claim 13 wherein each cam follower comprises a rotatable roller sliding over a roller bushing positioned around the second rivet.

15. The parking brake control of claim 1, 2 or 3 wherein the input lever assembly comprises a foot pedal.

16. The parking brake control of claim 15 wherein the input lever assembly further comprises a reinforcement plate attached to the foot pedal.

17. The parking brake control of claim 15 further comprising a foot pad attached to an end of the foot pedal.

18. The parking brake control of claim 1, 2 or 3 further comprising means for releasably locking the sector.

19. The parking brake control of claim 18 wherein the means for releasably locking the sector comprises a one-way clutch comprising:

a pinion having pinion teeth rotatably attached to the mounting plate assembly engagable with teeth on the sector;

a wrap spring wrapped around the pinion, wherein motion of the sector towards the full brake engagement position urges the wrap spring to unwind and allow rotation of the pinion, and motion of the sector towards the full release position urges the wrap spring to tighten around the pinion and resist rotation of the pinion, locking the sector; and a release lever urging the spring to unwind and permitting rotation of the pinion which unlocks the sector allowing return to the full release position.

20. The parking brake control of claim 2 wherein about 30–45% of the total cable movement is achieved in the first 10 degrees of rotation of the lever assembly.

* * * * *